United States Patent [19]

Pink et al.

[11] Patent Number: 5,037,563

[45] Date of Patent: Aug. 6, 1991

[54] ALUMINUM COMPLEX GREASE AND METHOD OF REDUCING THE FLAMMABILITY OF AN ALUMINUM COMPLEX GREASE

[75] Inventors: Harry S. Pink, Whitehouse Station; Heinrich J. Rohrhofer, Fords, both of N.J.

[73] Assignee: Exxon Research and Engineering Company, Florham Park, N.J.

[21] Appl. No.: 590,120

[22] Filed: Sep. 28, 1990

Related U.S. Application Data

[63] Continuation-in-part of Ser. No. 290,077, Dec. 27, 1988, abandoned.

[51] Int. Cl.[5] ..... C10M 125/00

[52] U.S. Cl. ..... 252/18; 252/25; 252/35; 106/18.11

[58] Field of Search ..... 252/18, 25, 35; 106/18.11

[56] References Cited

U.S. PATENT DOCUMENTS

| | | | |
|---|---|---|---|
| 2,417,428 | 3/1947 | Mclennan | 252/35 |
| 2,719,826 | 10/1955 | Hotten | 252/18 |
| 3,912,671 | 10/1975 | Kondo et al. | 106/18.23 |
| 4,610,922 | 9/1986 | Kumasaka et al. | 428/489 |

*Primary Examiner*—Prince E. Willis
*Assistant Examiner*—Jerry D. Johnson
*Attorney, Agent, or Firm*—John W. Ditsler

[57] ABSTRACT

The flammability of an aluminum complex grease can be reduced by incorporating a flame retardant amount of calcium oxide into the grease provided the calcium oxide has a Loss on Ignition value of less than 3.0.

15 Claims, No Drawings

ALUMINUM COMPLEX GREASE AND METHOD OF REDUCING THE FLAMMABILITY OF AN ALUMINUM COMPLEX GREASE

CROSS-REFERENCE TO RELATED APPLICATIONS

This application is a continuation-in-part of U.S. application Ser. No. 290,077 filed Dec. 27, 1988 now abandoned.

BACKGROUND OF THE INVENTION 1. Field of the Invention

This invention pertains to a method for reducing the flammability of an aluminum complex grease by adding certain calcium oxides to the grease. 2. Description of Related Art The addition of various calcium oxides to greases is known. For example, U.S. Pat. No. 3,933,657 discloses that from about 1 to 20 wt % lime is a conventional extreme pressure additive to a wide variety of greases, including greases having an aluminum base soap thickener. Specific properties of the lime are not discussed. As another example, U.S. Pat. No. 4,379,062 discloses a thread sealing and lubricating composition which contains 8–25% finely divided copper flakes, 5–20% finely divided aluminum particles, and 4–15% non-metallic, non-carbon powder suspended in a petroleum vehicle. The vehicle is preferably a petroleum stock or grease containing a metallic soap or an inorganic thickening agent. No mention is made of an aluminum complex grease as the thickener. In still another example, U.S. Pat. No. 2,719,826 discloses that the antiwear characteristics of an aluminum complex grease can be enhanced by dispersing from 0.02 to 7% calcium oxide or hydroxide therein, with the dispersion being stabilized by a polyvalent metal sulfonate.

However, none of these references disclose that the flammability of a grease having an aluminum complex thickener can be significantly reduced by incorporating specific amounts of certain calcium oxides therein.

SUMMARY OF THE INVENTION

The flammability of an aluminum complex grease can be significantly reduced by incorporating a flame retardant amount of calcium oxide therein provided the calcium oxide has a LOI (Loss on Ignition) value of less than 3.0.

DETAILED DESCRIPTION OF THE INVENTION

The flame retardant grease of this invention comprises (a) a lubricating oil, (b) an aluminum complex thickener, and (c) a flame retardant amount of calcium oxide having an LOI of less than about 3.0.

A wide variety of lubricating oils can be used to prepare the flame retardant grease of this invention. For example, the lubricating oil base can be any of the conventionally used mineral oils, synthetic hydrocarbon oils, or synthetic ester oils. In general these lubricating oils will have a viscosity in the range of from about 5 to about 10,000 cSt at 40° C., although typical applications will require an oil having a viscosity ranging from about 10 to about 1,000 cSt at 40° C. Mineral lubricating oil basestocks used can be any conventionally refined base stocks derived from paraffinic, naphthenic, and mixed base crudes. Synthetic lubricating oils that can be used include esters of dibasic acids such as di-2-ethylhexyl sebacate, esters of glycols such as $C_{13}$ oxide acid diester of tetraethylene glycol, or complex esters such as one formed from 1 mole of sebacic acid, 2 moles of tetraethylene glycol, and 2 moles of 2-ethylhexanoic acid. Other synthetic oils that can be used include synthetic hydrocarbons such as polyalphaolefins; alkyl benzenes, alkylate bottoms from the alkylation of benzene with tetrapropylene or with the copolymers of ethylene and propylene; silicon oils, e.g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethyl carbonate to form a half ester followed by reaction of the latter with tetraethylene glycol; and the like. Other suitable synthetic oils include the polyphenyl ethers, e.g. those having from about 3 to 7 ether linkages and about 4 to 8 phenyl groups. (See U.S. Pat. No. 3,424,678, column 3.) The amount of lubricating oil in the grease can also vary broadly, but, typically, will comprise a major portion, preferably from about 75 to about 95 wt. %, of the grease.

The grease will also contain a complex basic aluminum soap to thicken the lubricating oil. By "complex basic aluminum soaps" is meant that the aluminum soap molecule contains at least one hydroxy anion for each aluminum cation, and at least two dissimilar anions substantially hydrocarbonaceous in character. By "substantially hydrocarbonaceous anions" is meant those anions which are composed mainly of hydrogen and carbon, and include such anions which contain, in addition, minor amounts of substituents such as oxygen, nitrogen, etc.

The organo anions of the complex aluminum soaps are generally oleophilic (i.e., groups derived form or residues of acids, which are oil-soluble). However, one of the organo anions has a greater solubility in lubricating oil than another organo anion. The organo anions may be further characterized in that organo anions of greater oil solubility will be designated as "relatively oleophilic" anions, and the organo anions of lesser oil solubility will be designated as "relatively oleophobic" anions.

The aluminum di-soaps of each of the organo anions (i.e., the aluminum di-soaps of the oleophilic anion and the aluminum di-soaps of the oleophobic anion) are insoluble in water. For example, in the aluminum-benzoate-stearate example of this invention, the aluminum di-soap of the benzoate anion (i.e., aluminum di-benzoate) and the aluminum di-soap of the stearate anion (i.e., aluminum di-stearate) are insoluble in water.

The aluminum di-soaps of the more soluble organo anions (i.e., the relatively oleophilic anions) are soluble in a petroleum hydrocarbon lubricating oil (e.g., a solvent-refined paraffinic oil having a viscosity of 485 SSU at 100° F.) in an amount of at least 5% at 400° F. That is, at 400° F., 5% of the aluminum soap of the oleophilic organic anion will form a true solution in a petroleum hydrocarbon lubricating oil. On the other hand, the aluminum soaps of the less soluble organo anions (i.e., the relatively oleophobic anions) are soluble in a petroleum hydrocarbon lubricating oil in an amount of less than 1% at 400° F. That is, at 400° F., less than 1% (from 0% to about 1%) of aluminum soap containing the oleophobic anions will dissolve in a petroleum hydrocarbon lubricating oil to form a true solution.

Furthermore, the aluminum soaps of the relatively oleophobic anions melt at a temperature above 400° F., and the aluminum soaps of the relatively oleophilic anions melt at a temperature less than 350° F.

The aluminum complex soaps used in this invention form a polymeric network; i.e., the aluminum complex soaps have more than one aluminum atom and at least two dissimilar organo anions throughout the polymeric structure. The aluminum complex soaps may contain as many as 1,000 or more monomeric units, each monomeric unit containing one aluminum atom having all of its valences satisfied by at least one hydroxyl group and two organo anions. Thus, although aluminum has a valence of +3, there is no intention to limit the complex aluminum soap to one containing only three specific anions. In the over-all average, the valence bonds of the aluminum atoms can be directed to more than three specific anions; i.e., to more than one hydroxyl anion and more than two organo anions. The average molecule in the soap may contain a plurality of relatively oleophilic anions or a plurality of relatively oleophobic anions per aluminum atom. For example, an aluminum complex soap such as aluminum benzoate-stearate-caprylate may be used.

Suitable relatively oleophilic anions are anions of aliphatic (saturated and unsaturated), aromatic, aralkyl, and cycloaliphatic carboxylic acids. These acids must be sufficiently hydrocarbonaceous in character to impart the desired oil solubility. Thus, the aliphatic (saturated and unsaturated) carboxylic acids may contain from 8 to 30, preferably from 12 to 18, carbon atoms. The aliphatic substituent in the various cyclic carboxylic acids may contain at least 4 carbon atoms on the aliphatic group attached to the ring. The aralkyl, alkaryl, and cycloaliphatic carboxylic acids preferably contain a total of about 16 carbon atoms. The relatively oleophilic anion may be an alkyl phenol containing at least 4 carbon atoms in the alkyl group, preferably at least 15 carbon atoms in the alkyl group; e.g., cetyl phenol. Preferably, the organo-substituted acids of sulfur and phosphorus contain at least 14, more preferably at least 20, carbon atoms in the organo substituent. The oleophilic acid anions may contain various substituents such as hydroxy, amino, alkoxy (e.g., methoxy and like) radicals so long as the anion remains substantially hydrocarbonaceous in character.

Examples of the carboxylic acids from which the oleophilic anions are derived include caprylic acid, capric acid, lauric acid, myristic acid, palmitic acid, stearic acid, 12-hydroxy stearic acid, arachidic acid, melissic acid, oleic acid, linoleic acid, butyl benzoic acid, hexyl benzoic acid, actyl benzoic acid, dodecyl benzoic acid, phenyl butyric acid, phenyl hexanoic acid, phenyl decanoic acid, cetyl benzene sulfonic acid, a di-dodecyl benzene sulfonic acid (e.g., a di-polypropylene benzene sulfonic acid), an alkane phosphonic acid having at least 24 carbon atoms in the alkane group, cetyl thiophosphoric acid, naphthenic acid, etc. Of these, stearic acid, hydroxy stearic acids, naphthenic acids of molecular weight above about 250, and alkyl benzene sulfonic acids having at least 20 carbon atoms in the alkyl substituents are preferred.

The relatively oleophobic anions are substantially hydrocarbon in structure and may be selected from anions of aliphatic (saturated and unsaturated), aromatic, aralkyl, alkaryl, and cycloaliphatic mono- and polycarboxylic acids. Acids having up to two carboxyl groups are preferred, the monocarboxylic acids being particularly preferred. For the desired properties, aliphatic monocarboxylic acids of 4 to 7 carbon atoms are employed. When the carboxylic acid contains 2 carboxyl groups, the acid contains from 8 to 11 carbon atoms, and in some cases up to 20 carbon atoms, so long as the resulting anion is relatively oleophobic as compared to the oleophilic anion employed. The alkyl groups of the aralkyl and alkaryl carboxylic acids contain no more than 3 carbon atoms. Thus, the alkaryl and the aralkyl carboxylic acids contain a total of not more than 9 carbon atoms, preferably a total of 7 carbon atoms.

Suitable oleophobic anions are derived from benzoic acid, methyl benzoic acid, ethyl benzoic acid, toluic acid, phenyl acetic acid, phenyl propionic acid, suberic acid, azelaic acid, sebacic acid, phthalic acid, salicylic acid, carboxy methyl cellulose, polyacrylic acid, etc. Of these, the benzoic, azelaic, and toluic acids are preferred.

Examples of aluminum soaps which are effective thickening agents for grease compositions according to this invention include aluminum laurate, aluminum soap oleate, aluminum stearate, aluminum benzoate stearate, aluminum benzoate oleate, aluminum benzoate 12-hydroxy stearate, aluminum toluate stearate, aluminum benzoate naphthenate, aluminum benzoate hydrogenated rosin, aluminum benzoate sulfonate, aluminum azelate stearate, aluminum phosphate benzoate stearate, aluminum benzoate hydroxy stearate, etc. For additional information on aluminum complex greases, see H. W. Kruschwitz, "The Development of Formulations for Aluminum Complex Thickener Systems," pp. 51–59, NLGI Spokesman (May 1976), the disclosure of which is incorporated herein by reference.

The aluminum complex soap need only be present in the grease in an amount sufficient to thicken the oil to the consistency of a grease. Broadly, the amount of soap will range from about 1 to about 30 wt. % of the grease. Typically, however, from about 5 to about 20 wt. %, preferably from about 10 to about 15 wt. %, of the thickener will be present in the grease.

While not wishing to be bound by any particular theory, we believe that the effectiveness of calcium oxide as a flame retardant in an aluminum complex grease requires controlling to minimum levels the surface concentration of calcium carbonate. This is necessary because of calcium oxide's tendency to react with atmospheric carbon dioxide during normal storage and become "encapsulated" with a microscopic layer of calcium carbonate. While normally not a problem in general applications, this carbonate micro-layer is sufficient to "deactivate" the calcium oxide and render it ineffective as a flame retardant. Recarbonation of calcium oxide can be minimized by using freshly calcined calcium oxide that has been isolated or handled so as to minimize contact with atmospheric carbon dioxide. Alternatively, calcium oxide of flame retardant quality can be obtained from calcium oxide that has been rendered inactive (by recarbonation) by baking or heating the latter to a temperature of at least 600° C.

Loss of flame retardant activity due to recarbonation can be expressed as an increase in the "Loss on Ignition" parameter (see ASTM C 25-88). Loss on Ignition (LOI) is the loss in weight expressed as percent of the initial "as received" sample weight obtained after ignition of the sample at 1000° C. to constant weight. The loss in weight includes free moisture, chemically combined "lattice" or "hydroxy" water, volatile oxides of other impurities, and carbon dioxide from the decomposition of carbonates.

The amount of calcium oxide added need only be that sufficient (or effective) to reduce the flammability of the grease. Although the degree of reduced flammability desired and the particular lubricating oil used will influence the amount of calcium oxide used, the amount of calcium oxide added will be above 4 wt. % (preferably at least about 5 wt. %) and, typically, will range from above 4 to about 10 wt. %, although larger amounts could be used. Most preferably from about 5 to about 8 wt. % CaO will be used.

The aluminum complex grease of this invention may prepared by methods known in the art (see, for example, U.S. Pat. No. 3,591,505, the disclosure of which is incorporated herein by reference). Additional information on grease preparation techniques may be found in C.J. Boner, Manufacture and Application of Lubricating Greases, Reinhold Publishing Corp., New York (1954) and NLGI Lubricating Grease Guide, Second Edition, Published by NLGI, Kansas City, Missouri (1987), the disclosures of which are incorporated herein by reference. Preferably, calcium oxide is added to the grease during the final preparation stages.

In addition to the components already mentioned, the grease may also contain small amounts of other additives which include, but are not limited to, corrosion inhibitors, antiwear agents, pour point depressants, tackiness agents, extreme pressure agents, viscosity improvers, oxidation inhibitors, rust inhibitors, dyes, and the like.

The multipurpose grease of this invention has a variety of uses and may be suitably employed in essentially any application requiring a flame retardant grease, e.g. steel mills.

This invention will be further understood by reference to the following Examples which are not intended to restrict the scope of the claims appended hereto. In the Examples, the flammability of the greases tested were determined by placing a 50 gram sample of the grease on a steel panel in a fume hood and shaping the sample into a cone. A cardboard match is placed vertically downward on the surface of the cone. The body of the match is in contact with the surface of the grease, while the head is slightly (typically, ⅛ to ¼ of an inch) above the surface to facilitate lighting. The match is then ignited. Flammability is rated by the ease with which the grease ignites and burns. The height of the flame is also measured after two minutes.

EXAMPLE 1

Preparation of Aluminum Complex Grease Without Flame Retardant Additives

A laboratory grease kettle was charged with 56 parts of an oil blend of hydrofined naphthenic oils and asphalt. The viscosity of the blend was 1450 SUS at 100° F.

To this was added 4.62 parts of a mixture of tallow fatty acids (principally palmitic, stearic, and oleic), which was warmed to dissolve the fatty acids. This was followed by the addition of 3.70 parts of technical grade aluminum isopropoxide trimer (Kolate 7013 by Joseph Ayers, Inc.). Heat was applied to initiate reaction, and at 180° F., 2.40 parts of benzoic acid were added to complete the neutralization of the aluminum isopropoxide trimer.

The contents were heated to a temperature of 380° F., whereupon the thickened product was allowed to cool. When the temperature was below 150° F., 4.00 parts of a blend of commercial extreme pressure and anticorrosion additives was added, following which the grease was milled and adjusted to a penetration of 300 with the remainder of the base oil blend (30 parts).

EXAMPLE 2

Effect of Flame Retardant Additives on Aluminum Complex Grease

Flammability tests were performed on a 50 g sample of each of the following greases:

Aluminum complex base grease (without any flame retardant additives).

Aluminum complex base grease and Hydrol 710 (a commercial aluminum hydroxide flame retardant for plastics).

Aluminum complex base grease and Saytex 102E (a commercial brominated aromatic flame retardant for plastics).

Aluminum complex base grease and 3:1 blend of Saytex 102A and antimony oxide (a commercial flame retardant system for plastics).

Aluminum complex base grease and powdered calcium oxide.

The results of these tests are shown in Table 1 below.

TABLE 1

| Grease | wt. % Additive | Flammability |
|---|---|---|
| Base grease | — | Grease ignited and burned with 5 inch flame. 2nd try: same result. |
| Base grease and Hydrol 710 | 10 | Grease ignited and burned with 5 inch flame. 2nd try: same result. |
| Base grease and Saytex 102E | 10 | Grease ignited and burned with 5 inch flame. 2nd try: same result. |
| Base grease and Saytex 102A/ Antimony Oxide Blend | 10 | Grease ignited and burned with 5 inch flame. 2nd try: same result. |
| Base grease and CaO | 5 | Grease did not ignite. 2nd try: same result. |

the data in Table 1 show that the commercial flame retardants had no effect on flammability, but that calcium oxide produced an aluminum complex grease which did not burn under the test conditions.

EXAMPLE 3

Minimum CaO Concentration Required to Impart Flame Retardancy to Aluminum Complex Grease The flammability of several 50 g samples of the aluminum complex base grease prepared in Example 1 was tested using various concentrations of CaO having an LOI of 2.75 wt. %. The results of these tests are shown in Table 2 below.

TABLE 2

| wt. % CaO | Flammability |
|---|---|
| 1.5 | Grease ignited and burned. |
| 2.5 | Grease ignited and burned. |
| 3.0 | Grease ignited and burned. |
| 4.0 | Grease sample did not ignite |

TABLE 2-continued

| wt. % CaO | Flammability |
|---|---|
| | on first attempt, but ignited and burned on a second attempt. A second sample did not ignite on three attempts. |
| 5.0 | Grease did not ignite on three attempts and on several repeat attempts. |

The data in Table 2 show that above 4 wt. % CaO must be present in the grease to impart flame retardancy.

EXAMPLE 4

CaO Imparts Flame Retardancy Only to Aluminum Complex Grease

Flammability tests on 50 g samples of several greases containing 5 wt. % powdered CaO (with an LOI of 2.75 wt. %) were performed. The results of these tests are shown in Table 3 below.

TABLE 3

| Grease | wt. % CaO | Flammability |
|---|---|---|
| Aluminum complex grease | 5 | Grease did not ignite. |
| Lithium complex grease | 5 | Grease ignited and burned with 4 inch flame. |
| Calcium complex EP grease | 5 | Grease ignited and burned with 3 inch flame. |
| Polyurea grease | 5 | Grease ignited and burned with 3 inch flame. |

The data in Table 3 show that the addition of CaO to lithium complex, calcium complex, and polyurea based greases did not produce a flame retardant product.

EXAMPLE 5

Calcium Oxide Used Must Have an LOI Value Below 3.0

Two series of flammability tests were performed on 50 g samples of the aluminum complex base grease prepared in Example 1 to which were added 5 wt. % of calcium oxide at various stages of recarbonation (as indicated by the LOI values).

In the first series of tests, recarbonation was achieved by exposing freshly calcined commercially available calcium oxide to an atmosphere containing calcium dioxide in a closed dessicator maintained at 70% relative humidity. The calcium oxide was freshly calcined by baking at 600° C. for 16 hours to remove any calcium carbonate that may be present. Samples were then removed from the dessicator after various periods of exposure and flammability tests performed. The results of these tests are shown in Table 4 below:

TABLE 4

| Sample | Time Exposed to $CO_2$, hr. | LOI % | Flammability |
|---|---|---|---|
| A | 0.5 | 1.16 | Grease did not ignite |
| B | 1.0 | 1.43 | Grease did not ignite |
| C | 1.5 | 1.68 | Grease did not ignite |
| D | 2.0 | 1.95 | Grease did not ignite |
| E | 2.5 | 1.78 | Grease did not ignite |
| F | 3.0 | 2.33 | Grease did not ignite |
| G | 3.0 | 2.38 | Grease did not ignite |

TABLE 4-continued

| Sample | Time Exposed to $CO_2$, hr. | LOI % | Flammability |
|---|---|---|---|
| H | 3.5 | 2.41 | Grease did not ignite |
| I | 4.0 | 3.44 | Grease ignited and burned |
| J | 4.5 | 3.23 | Grease ignited and burned |
| K | 5.0 | 3.88 | Grease ignited and burned |
| L | 5.5 | 4.29 | Grease ignited and burned |
| M | 6.0 | 4.11 | Grease ignited and burned |
| N | 6.5 | 4.67 | Grease ignited and burned |

In another series of tests, different lots of the same commercially available calcium oxide were tested as received after baking at 600° C. for 4 hours to remove any calcium carbonate that may be present (i.e. form a freshly calcined calcium oxide).

Samples O and P were freshly calcined calcium oxide maintained in sealed containers to insure minimum recarbonation. Sample Q was originally calcined, but allowed to react with atmospheric carbon dioxide through repeated opening and closing of the container. Sample R is Sample Q that was baked for 4 hours at 600° C. Sample S was commercial calcium oxide having an LOI of 6.8% as received. The results of these tests are shown in Table 4 below:

TABLE 5

| Sample | LOI, % | Flammability |
|---|---|---|
| O | 2.00 | Grease did not ignite |
| P | 2.75 | Grease did not ignite |
| Q | 7.6 | Grease ignited and burned |
| R | 1.2 | Grease did not ignite |
| S | 6.8 | Grease ignited and burned |

The data in Tables 4 and 5 show that the aluminum complex grease samples formed will not ignite if the LOI value of the calcium oxide used in the grease is less than 3.0, preferably less than 2.75. The reproducibility of ASTM C 25-88 test is 0.71%.

What is claimed is:

1. A method for reducing the flammability of an aluminum complex grease which comprises adding above 4.0 wt % calcium oxide to the grease wherein the calcium oxide has an LOI value of less than 3.0.

2. The method of claim 1 wherein from above 4 to about 10 wt. % calcium oxide is added to the grease.

3. The method of claim 1 wherein at least about 5 wt % calcium oxide is added to the grease.

4. The method of claim 3 wherein from about 5 to about 8 wt % calcium oxide is added to the grease.

5. A flame retardant grease composition comprising
(a) a lubricating oil,
(b) an aluminum complex thickener, and
(c) a flame retardant amount of calcium oxide having an LOI value of less than 3.0.

6. The composition of claim 5 wherein from above 4 to about 10 wt % calcium oxide is added to the grease.

7. The composition of claim 5 wherein at least about 5 wt % calcium oxide is added to the grease.

8. The composition of claim 7 wherein from about 5 to about 8 wt % calcium oxide is added to the grease.

9. A flame retardant grease composition comprising
(a) a major amount of lubricating oil,
(b) from about 1 to about 30% of an aluminum complex thickener, and
(c) greater than 4.0 wt % of calcium oxide having a LOI value of less than 3.0.

10. The composition of claim 9 wherein from greater than 4 to about 10 wt % calcium oxide is added to the grease.

11. The composition of claim 10 wherein from about 5 to about 20 wt % of the thickener is present in the grease.

12. The composition of claim 9 wherein at least about 5 wt % calcium oxide is added to the grease.

13. The composition of claim 12 wherein from about 5 to about 8 wt % calcium oxide is added to the grease.

14. The composition of claim 13 wherein from about 10 to about 15 wt % of the thickener is present in the grease.

15. The composition of claim 13 wherein the calcium oxide has an LOI value of 2.75 or less.

* * * * *